US007100782B2

(12) United States Patent
Hanna

(10) Patent No.: US 7,100,782 B2
(45) Date of Patent: Sep. 5, 2006

(54) BABY BOTTLE PACKAGE

(76) Inventor: Lori Hanna, 1066 W. 1700 South, Salt Lake City, UT (US) 84104

( * ) Notice: Subject to any disclaimer, the term of this patent is extended or adjusted under 35 U.S.C. 154(b) by 176 days.

(21) Appl. No.: 10/686,264

(22) Filed: Oct. 14, 2003

(65) Prior Publication Data

US 2004/0074859 A1 Apr. 22, 2004

Related U.S. Application Data

(60) Provisional application No. 60/417,691, filed on Oct. 11, 2002.

(51) Int. Cl.

| | |
|---|---|
| ***A61J 9/00*** | (2006.01) |
| ***A61J 11/00*** | (2006.01) |
| *A61J 9/06* | (2006.01) |
| *A61J 9/08* | (2006.01) |

(52) U.S. Cl. ..... 215/11.6; 215/11.1; 215/386; 215/393; 220/737; 248/102; 248/105

(58) Field of Classification Search ..... 215/11.1, 215/11.6, 399, 386, 395, 397; 248/102, 105; 220/737, 743

See application file for complete search history.

(56) References Cited

U.S. PATENT DOCUMENTS

| | | | | | |
|---|---|---|---|---|---|
| 974,941 | A | * | 11/1910 | Cook | 36/7.6 |
| 1,636,174 | A | * | 7/1927 | Dolan et al. | 215/384 |
| 2,834,496 | A | * | 5/1958 | Boston et al. | 215/11.1 |
| 3,058,708 | A | * | 10/1962 | Murray et al. | 248/102 |
| 3,065,873 | A | * | 11/1962 | Plate | 215/11.1 |
| 3,144,230 | A | * | 8/1964 | Brooks | 248/102 |
| 3,163,332 | A | * | 12/1964 | Boyle et al. | 222/180 |
| 3,212,660 | A | * | 10/1965 | Adell | 248/313 |
| 3,225,950 | A | * | 12/1965 | Josephsen et al. | 215/384 |
| 3,373,864 | A | * | 3/1968 | Bsrton et al. | 206/471 |
| 3,393,817 | A | * | 7/1968 | Meierhoefer | 215/11.5 |
| 3,519,157 | A | * | 7/1970 | Meierhoefer | 215/11.6 |
| 3,530,979 | A | * | 9/1970 | Jarman et al. | 206/525 |
| 3,533,526 | A | * | 10/1970 | Adell | 215/399 |
| 3,635,724 | A | * | 1/1972 | Schaar | 426/117 |
| 3,746,198 | A | * | 7/1973 | Howland | 215/11.1 |
| 3,779,413 | A | * | 12/1973 | Pickerell et al. | 215/11.6 |
| 3,804,952 | A | * | 4/1974 | MacDonald | 426/117 |
| 3,935,956 | A | * | 2/1976 | Sansanelli | 215/399 |
| 4,101,043 | A | * | 7/1978 | Johnson et al. | 215/399 |
| D249,076 | S | * | 8/1978 | Meeker et al. | D30/132 |

(Continued)

FOREIGN PATENT DOCUMENTS

| | | | |
|---|---|---|---|
| CH | 674458 | A5 * | 6/1990 |

(Continued)

*Primary Examiner*—Sue A. Weaver
(74) *Attorney, Agent, or Firm*—Clayton, Howarth & Cannon, P.C.

(57) ABSTRACT

A baby bottle is disclosed containing a beverage that may be ready to consume. The bottle includes a receptacle for receiving a liquid beverage for feeding to an infant or small child. The receptacle may have an opening with a safety seal covering to protect the beverage from contamination. A cap with a nipple may be placed over the opening and a cover may be placed over the cap and nipple to keep the nipple sanitary. A ring seal may be used to attach the cover to the receptacle to indicate when the cover has been removed. Beverages such as milk, formula, juice or water may be packaged in the bottle in a condition ready to consume. After the beverage has been consumed, the bottle may be disposed or cleaned for repeated use.

16 Claims, 4 Drawing Sheets

U.S. PATENT DOCUMENTS

| | | | | | |
|---|---|---|---|---|---|
| 4,463,859 | A | * | 8/1984 | Greene | 215/11.1 |
| 4,706,827 | A | * | 11/1987 | Cabernoch et al. | 215/11.3 |
| 4,759,453 | A | * | 7/1988 | Paetzold | 215/11.1 |
| 5,105,958 | A | * | 4/1992 | Patton | 215/388 |
| 5,170,533 | A | * | 12/1992 | Barry | 16/425 |
| 5,215,203 | A | * | 6/1993 | Malcolm | 215/384 |
| 5,263,599 | A | * | 11/1993 | Sklar | 215/11.1 |
| RE34,725 | E | * | 9/1994 | Braden | 119/18 |
| 5,411,155 | A | * | 5/1995 | Gordon et al. | 215/11.1 |
| 6,073,788 | A | * | 6/2000 | Stroud | 215/11.1 |
| 6,092,680 | A | * | 7/2000 | Pillado | 215/11.1 |
| 6,138,847 | A | | 10/2000 | Johnson | 215/11.1 |
| 6,171,623 | B1 | * | 1/2001 | Gaylor et al. | 426/117 |

FOREIGN PATENT DOCUMENTS

| | | | | | |
|---|---|---|---|---|---|
| GB | 2170410 | A | * | 8/1986 | |
| JP | 405042197 | A | * | 2/1993 | 215/11.1 |

* cited by examiner

BABY BOTTLE PACKAGE

CROSS-REFERENCE TO RELATED APPLICATIONS

This application claims the benefit of U.S. Provisional Application No. 60/417,691, filed Oct. 11, 2002, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to containers for dispensing liquids, and more particularly, but not necessarily entirely, to baby bottle containers for dispensing liquids that are ready to use.

2. Description of Related Art

There are currently numerous types of beverage containers in the form of baby bottles for use in feeding infants and small children. Conventional baby bottles may include a glass or plastic container having an externally threaded container opening, a nipple, and a screw-on top for securing the nipple to the container.

The baby bottles may be used to feed infants liquids such as milk, formula, juices, or water. Preparing the liquids to feed infants or small children may be time consuming and difficult to accomplish, especially while traveling, or for working parents, baby sitters, new parents or nighttime feedings. For example, the reusable baby bottles and nipples must be properly cleaned and sterilized to prevent the spread of harmful contaminants. Also, formula and juices frequently require dilution of a concentrate or mixing of a powder with water. Improperly mixed beverages may cause illnesses to infants or small children.

Also, some components of the bottle, such as the nipple, are subject to wear and are prone to damage through use and cleaning. Accordingly, it is frequently required to replace the nipples which adds to the inconvenience of the known baby bottles. Moreover, the bottles are often difficult to grasp by toddlers or care givers due to the smooth slippery nature of the bottles. It is also often difficult to support the bottle in a desired orientation to feed an infant or small child.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
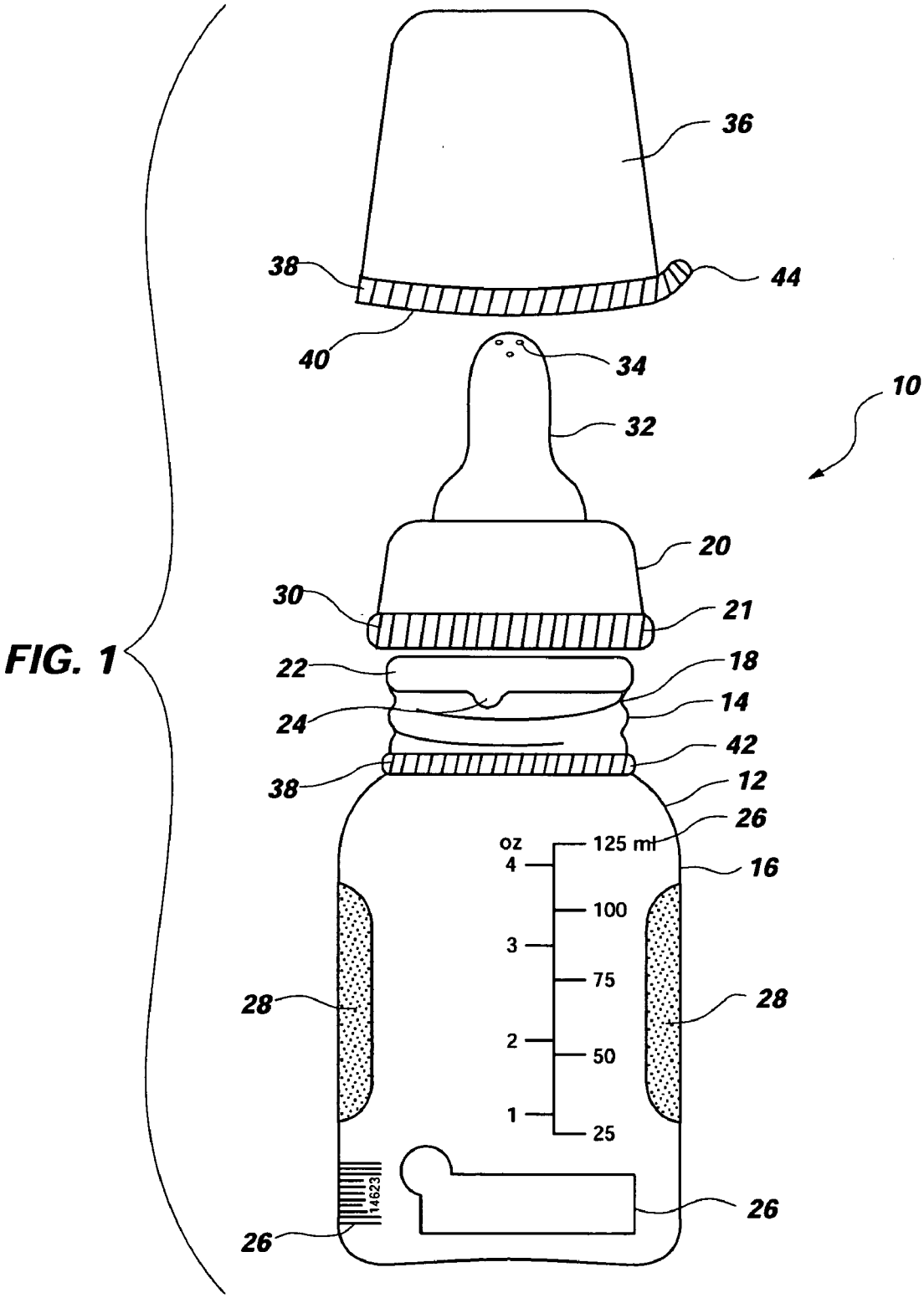
FIG. 1 is an exploded perspective view of a container in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. As used herein, the terms "comprising," "including," "containing," "characterized by," and grammatical equivalents thereof are inclusive or open-ended terms that do not exclude additional, unrecited elements or method steps.

Referring now to FIG. 1, an exploded perspective view is shown of a container, indicated generally at 10, also sometimes referred to as a baby bottle. The container 10 may include a receptacle 12 for containing a liquid such as milk, formula, juice or water, for example. It will be understood that various different kinds of beverages may be placed in the receptacle, such as whole milk, 2% milk, chocolate or strawberry flavored milk, or any other beverage known in the art may be placed in the container 10. In one embodiment of the present disclosure, a measured amount of powder or concentrate may be contained in the receptacle 12, such that the beverage may be prepared for feeding an infant or small child by simply adding water.

It will be understood that the receptacle 12 may be formed of any of a variety of materials, such as plastic, glass, carton, or metal for example, and that the receptacle 12 may be formed in various different sizes and shapes. For example, the receptacle 12 may be formed of a clear plastic material in a cylindrical shape sized to hold 4 or 8 ounces. However, it will be appreciated that the receptacle 12 may have any other size and shape within the scope of the present disclosure.

The receptacle 12 may include a neck portion 14 and a body portion 16. The neck portion 14 may have a reduced diameter with respect to the body portion 16, and may have threads 18 for threaded engagement with a threaded cap 20. The neck 14 may have a rim defining an opening of the receptacle 12. The rim may be formed by the end of the sidewall forming the end of the neck 14.

A safety seal 22 may be disposed over the opening of the receptacle 12 to protect the contents of the receptacle from contamination and to serve as an indicator that the receptacle 12 has not been opened. The safety seal 22 may be formed of a flexible material, such as a metal foil or plastic material, and may be adhered to the rim surrounding the opening of the receptacle 12. The safety seal 22 may include a pull tab 24 such that a user may grasp the pull tab 24 to remove the safety seal 22 from the rim surrounding the opening of the receptacle 12 to enable access to the contents of the receptacle 12. It will be understood that various types of adhesives and sealing procedures known in the art may be used to place the safety seal 22 on the receptacle 12, and that the contents of the receptacle may be vacuum packed such that the safety seal 22 forms a vacuum pack seal.

The receptacle 12 may also include indicia 26 for providing information to the user of the container 10. For example, the indicia may include markings to indicate the quantity of liquid remaining in the receptacle 12 so that the proper amount of liquid dispensed may be determined. Also, the receptacle 12 may include indicia 26 indicating the type of contents within the receptacle, or the nutritional value of the contents. Moreover, the indicia 26 may include a bar code or any other information relevant to the container 10.

One embodiment of the receptacle 12 may include grips 28 for enabling a user of the container 10 to hold the receptacle 12 without slipping. The grips 28 may be formed of a rubber material or any other material that may facilitate grasping of the receptacle 12, or a roughened surface. The grips 28 may be positioned on a central portion of the receptacle 12 on opposing sides of the receptacle 12, such that a person may be able to place a thumb on a grip 28 on one side of the receptacle 12, and fingers on the grip 28 on the opposing side to facilitate handling of the receptacle 12 without slipping. Accordingly, the grips 28 may be arranged in discrete areas of the receptacle 12.

The threaded cap 20 may be formed of a plastic material and may have threads corresponding to the threads 18 on the neck. The cap 20 may also have ridges 30 to facilitate gripping the cap 20 to tighten or loosen the cap on the threads 18. The cap 20 may also include a nipple 32 protruding from a central portion of the top in a manner known in the art, for allowing an infant or small child to drink the contents of the receptacle 12. The nipple 32 may be made of a flexible material, such as natural or synthetic rubber. The nipple 32 may also have nipple openings 34 through which the contents of the receptacle may pass to the infant or small child in a manner known in the art.

The container 10 may also include a cover 36 configured to extend over the cap 20 and nipple 32 to keep the nipple sanitary. The cover 36 may be transparent so that the cap 20 and nipple 32 may be viewed through the cover 36, or the cover 36 may be configured to obscure the cap 20 and nipple 32. The cover 36 may be sized to slide over the perimeter of the cap 20 and may be sized to frictionally engage the perimeter of the cap 20 so that the cover 36 may be held in place. In one embodiment, the cap may include a protruding edge 21 which may engage the cover 36 in a friction fit. The cover 36 may allow the nipple 32 to be protected from dirt or contamination so that if only a portion of the contents of the container 10 are consumed, the nipple 32 may remain clean for use at a later time.

The container 10 may also include a ring seal 38 between the cover 36 and the receptacle 12. It will be understood that the ring seal 38 may sometimes be referred to as a ziplock seal, or a twist cap seal. The ring seal 38 may include any of a variety of ring seals 38 known in the art for sealing a lid to a container. For example, one embodiment of the ring seal 38 may include a split plastic ring with a first portion 40 of the ring seal 38 attached to the cover 36, and a second portion 42 of the ring seal 38 attached to the receptacle 12. The first portion 40 of the ring seal 38 may be attached to the second portion 42 of the ring seal 38 at a series of attachment points. The ring seal 38 may also include a ring seal tab 44 that may be pulled to separate the first portion 40 from the second portion 42 by breaking the attachment at the attachment points. The first portion 40 may be removed from the cover 36 and discarded, whereas the second portion 42 may remain attached to the receptacle 12. It will be understood that the ring seal 38 may be arranged such that the ring tab 44 is on the second portion 42, and the first portion 40 remains attached to the cover 36 within the scope of the present disclosure.

An alternative embodiment of the ring seal 38 may not have the seal tab 44. Rather, the first portion 40 of the ring seal 38 may be attached to the cover 36 and the second portion 42 of the ring seal 38 may be attached to the receptacle 12 such that as the cover 36 is rotated with respect to the receptacle 12, the first portion 40 of the ring seal 38 breaks apart from the second portion 42 of the ring seal 38. Accordingly, the first portion 40 of the ring seal 38 remains with the cover 36, and the second portion 42 of the ring seal 38 remains with the receptacle 12. The first portion 40 of the ring seal 38 may be integral with the cover 36, and the second portion 42 of the ring seal 38 may be integral with the receptacle 12 within the scope of the present disclosure.

Figure 3:
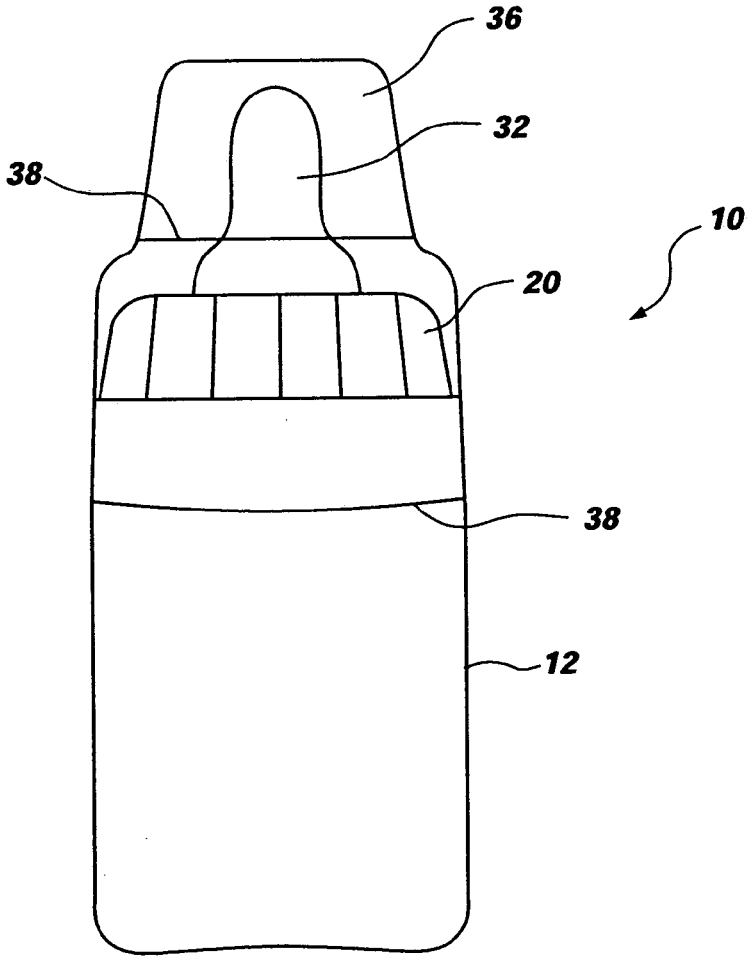
FIG. 3 is a side view of a container having the cap attached with a shrink wrap seal.

A further embodiment of the ring seal 38 may include a shrink wrap material, shown most clearly in FIG. 3. The shrink wrap material may include a plastic material that has been formed across the junction of the cover 36 and the receptacle 12 such that the shrink wrap material must be torn, removed or displaced in order to separate the cover 36 from the receptacle 12. Accordingly, the ring seal 38 may be used to prevent the cover 36 from being removed from the receptacle 12 without providing evidence that the container 10 has been opened or otherwise tampered with. It will be understood that the shrink wrap material may cover a portion of the container 10 or the entire container 10.

It will be understood that the container 10 may be filled with a beverage and sealed with the safety seal 22 and ring seal 38. The nipple 32 may be placed in an upright position on the receptacle 12 so as to be stored outside the receptacle 12. This allows the nipple 32 to be stored without contacting the beverage, so that cleaner handling of the container 10 may be accomplished. Accordingly, unwanted spreading of the beverage may be reduced as compared to baby bottles that store the nipple within the receptacle. The cover 36 may cover the nipple 32 to maintain the nipple 32 in a clean environment. Accordingly, the contents of the receptacle 12 may be provided and stored for purchase or use in a ready to use condition. All a care giver needs to do is remove the ring seal 38, the cover 36, the cap 20, and the safety seal 22, then replace the cap 20 and the beverage is ready to feed to an infant or small child.

Figure 2:
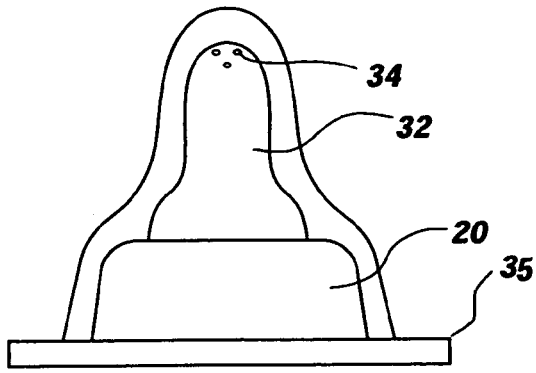
FIG. 2 a side view of an individually packaged nipple.

It will be appreciated that the container 10 may be disposed after the contents of the receptacle 12 are depleted. It will also be understood that the container 10 may be cleaned and re-used repeatedly. Some infants prefer nipples 32 of a particular size, shape, or configuration. Also, the nipples 32 often wear out before the other components of a baby bottle. Accordingly, as shown most clearly in FIG. 2, nipples 32 may be packaged and purchased separately from the container 10. The nipples 32 may be vacuum packed in individual nipple packages 35, also sometimes referred to as blister packs, for use with the container 10. It will also be understood that the nipples may be sized for use with other existing beverage containers, and that the nipples 32 may be configured in different shapes and sizes.

Figure 4:
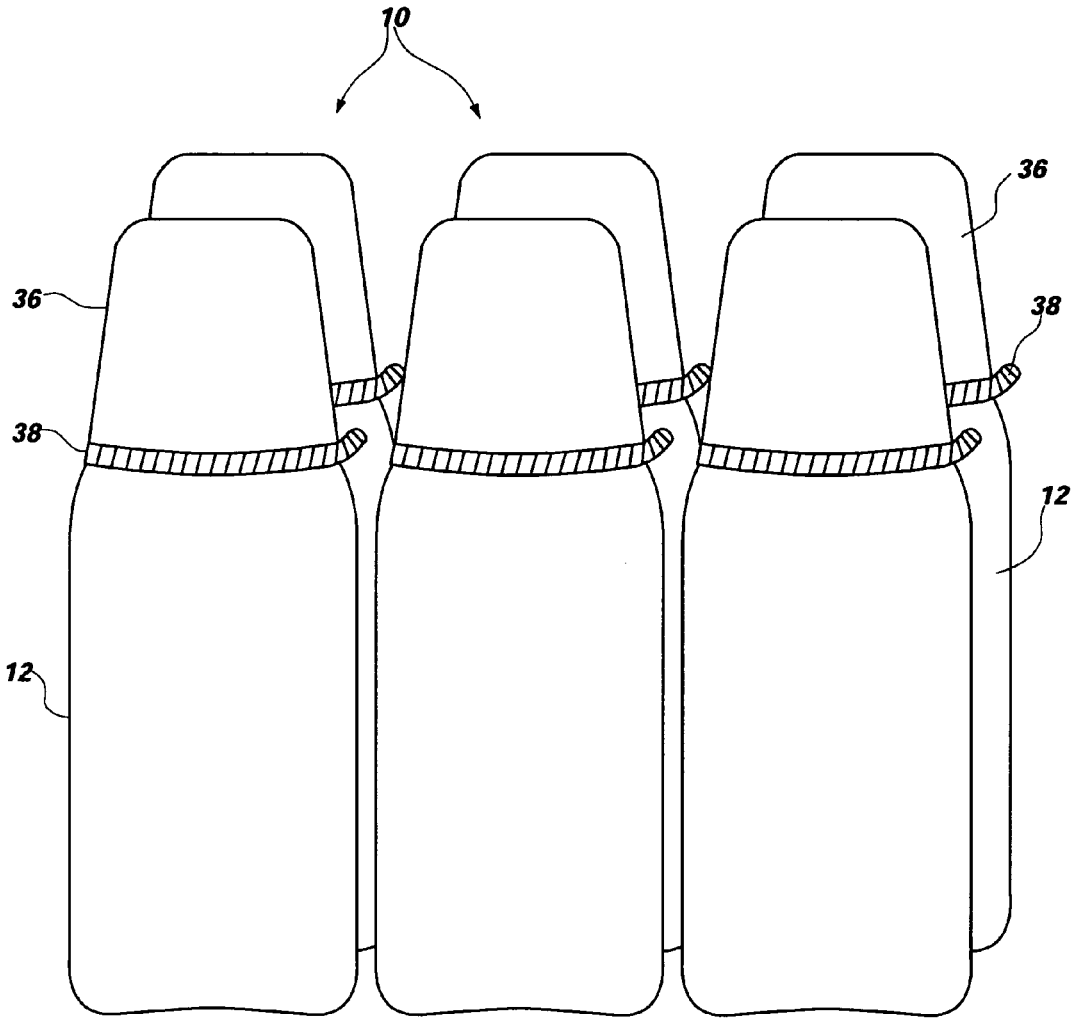
FIG. 4 is a perspective view of a package of multiple containers.

As shown in FIG. 3, the containers 10 may be configured to be sold individually, or as shown in FIG. 4, the containers 10 may be packaged for sale in multiple groups. For example, the containers 10 may be sold in six-packs, or four-packs or any other quantity of containers 10. It will be understood that the containers may be decorated with characters or designs that may increase the interest and appearance of the containers 10.

Figure 5:
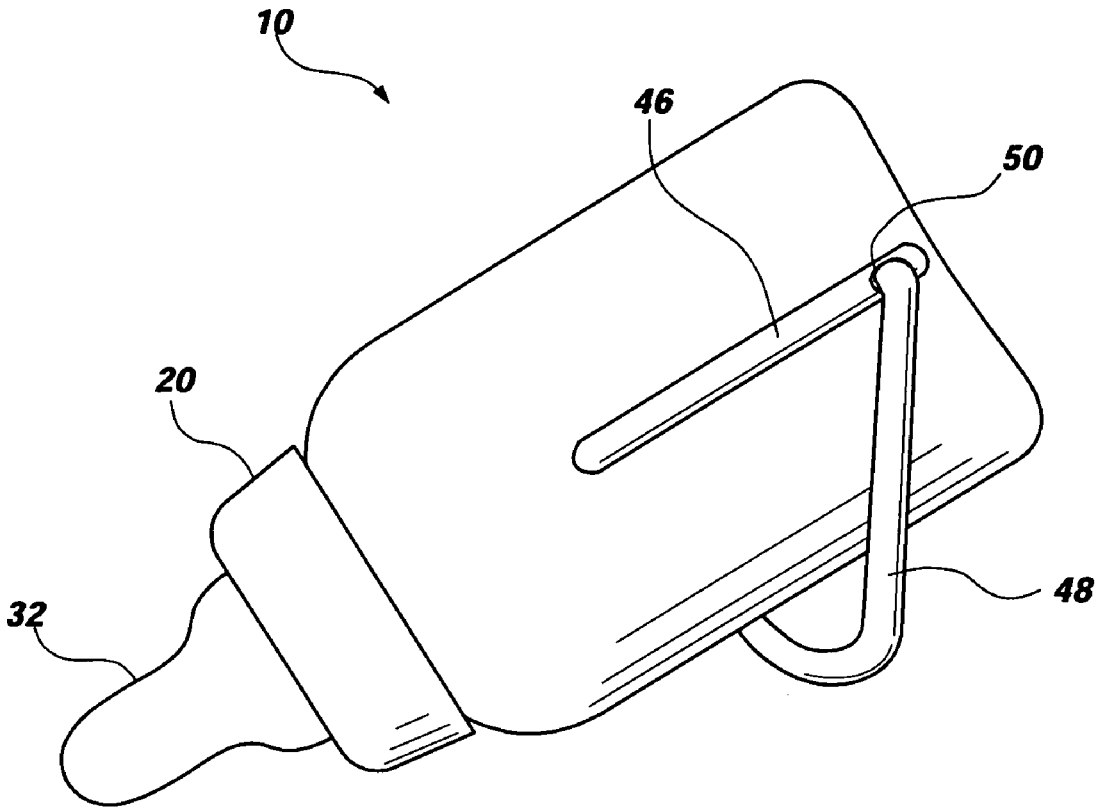
FIG. 5 is a perspective view of a container having a support member to prop the container in an angled orientation for feeding.

Referring now to FIG. 5, an additional optional feature of the container 10 is disclosed. It will be understood that the features of the disclosure depicted in FIG. 5 may be used in combination with the other features of the disclosure depicted in FIGS. 1–4 and described herein. The receptacle 12 may include a pair of grooves 46 on opposing sides of the body 16. A support 48 may be received in the grooves 46 and may extend from the grooves 46 for propping the receptacle 12 at a desired angle to allow the contents of the receptacle 12 to flow to the nipple 32 without the need for a person to constantly hold the bottle. Opposing ends of the support 48 may form rods 50 that are received in the grooves 46. It will be understood that the groove 46 may be shaped so that the angle of the bottle may be adjusted by sliding the support 48 along the length of the bottle. Moreover, the support 48 may pivot with respect to the bottle to further adjust the angle of the bottle. The support 48 may be somewhat U shaped and curved to conform to the shape of the receptacle 12. Additionally, the support 48 may be flexible so that it may be deflected to remove the rods 50 from the grooves 46 to remove the support 48 from the bottle if desired. In another embodiment, the groove 46 may be round in shape to hold the support in a single location on the bottle.

In accordance with the features and combinations described above, a useful method of providing a beverage to an infant or a young child may include the steps of:

(a) providing a container having a receptacle, a cap with a nipple, and a cover for covering the cap and nipple;

(b) providing the beverage in the receptacle in a condition ready for the infant or young child to consume;

(c) sealing the beverage in the receptacle with a safety seal; and (d) covering the nipple and cap with the cover and sealing the cover to the receptacle with a ring seal.

Those having ordinary skill in the relevant art will appreciate the advantages provide by the features of the present disclosure. For example, it is a feature of the present disclosure to provide a container that is simple in design and manufacture for providing a liquid for an infant or small child. It is a further feature of the present disclosure to provide a container with a beverage for feeding to infants or small children that provides the beverage ready to consume. It is an additional feature of the present disclosure to provide a container with safety seals and a cover to maintain the beverage and nipple clean. Another feature of the present disclosure is to provide such a container that is convenient for use while traveling, or for working parents, baby sitters, new parents or nighttime feedings. It is a further feature of the present disclosure, in accordance with one aspect thereof, to provide a container that can be held easily without slipping. It is an additional feature of the present disclosure to provide a container that can be held in a desired angle. It is a further feature of the present disclosure to provide such a container that may be disposable or reused.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A container for providing a liquid for an infant or small child, said container comprising:

a receptacle for receiving said liquid, said receptacle comprising a body portion and a neck portion, said neck portion having a rim defining an opening;

a safety seal removably attached to said rim and covering said opening;

a cap attached to said neck portion, said cap comprising a nipple;

a cover removably attachable to said receptacle, said cover defining an enclosure that is sized and dimensioned for receiving said cap and said nipple therein; and a ring seal between said cover and said receptacle for indicating when said cover has been removed from said receptacle wherein said body portion of said receptacle comprises a pair of grooves on opposing sides of said body portion, and a support is received in said grooves for holding said receptacle at an angle;

wherein said grooves extend in a direction from a bottom of said body portion toward said neck portion;

wherein said support comprises a substantial U shaped member having rods on opposing ends for being received into said grooves to allow said support to Divot with respect to said receptacle, said support further comprising two substantially straight members extending from said rods and a curved portion joining said two substantially straight portions opposite said rods, said curved portion conforming to a shape of said body portion;

whereby said rods slide along said grooves to chance a position of said support with respect to said body portion to thereby adjust said angle of said receptacle.

2. The container of claim 1, wherein said neck portion comprises threads and said cap is threadably engageable with said neck portion.

3. The container of claim 1, wherein said receptacle comprises grips to facilitate holding said container without slipping, wherein said grips comprise two separate and discrete gripping surfaces disposed on opposing sides of the receptacle.

4. The container of claim 1, wherein said cap comprises a protruding edge for contacting said cover in a friction fit.

5. The container of claim 1, wherein said receptacle comprises indicia for providing information to a user of the container.

6. The container of claim 1, wherein said safety seal comprising a pull tab for grasping to remove said safety seal from said rim.

7. The container of claim 1, wherein said ring seal comprises a first portion attached to said cover and a second portion attached to said receptacle, and wherein said first portion comprises a ring tab for pulling said first portion to remove said first portion from said cover to thereby allow separation of said cover from said receptacle.

8. The container of claim 1, wherein said ring seal comprises a first portion attached to said cover and a second portion attached to said receptacle, and wherein said first portion and said second portion are removably attached to each other.

9. The container of claim 1, wherein said ring seal comprises a shrink wrap material covering a junction between said cover and said receptacle.

10. The container of claim 1, wherein said neck portion comprises threads and said cap is threadably engageable with said neck portion;

wherein said receptacle comprises grips to facilitate holding said container without slipping;

wherein said grips comprise two separate and discrete gripping surfaces disposed on opposing sides of the receptacle body portion;

wherein said receptacle comprises indicia for providing information to a user of the container;

wherein said indicia comprise at least one of a group consisting of a bar code, a description of the liquid, and markings to indicate the quantity of liquid in the receptacle;

wherein said safety seal comprising a pull tab for grasping to remove said safety seal from said rim;

wherein said ring seal comprises a first portion attached to said cover and a second portion attached to said receptacle, and wherein said first portion comprises a ring seal tab for pulling said first portion to remove said first portion from said cover to thereby allow separation of said cover from said receptacle;

wherein said cap comprises a protruding edge and said cover is configured to engage with said protruding edge with a friction fit to allow said cover to be removably replaced on said receptacle; and wherein said nipple comprises a flexible material and at least one nipple opening for allowing said liquid to pass therethrough.

11. A container for providing a liquid for an infant or small child, said container comprising:

a receptacle for receiving said liquid, said receptacle comprising a body portion and a neck portion, said neck portion having a rim defining an opening; and a cap threadably attachable to said neck portion, said cap comprising a nipple;

wherein said receptacle comprises grips disposed on said body portion to facilitate holding said container without slipping, said grips comprising two separate and discrete gripping surfaces disposed on opposing sides of the receptacle, said gripping surfaces comprising a material or texture which is different than a material or texture in a remainder of said receptacle;

wherein said body portion of said receptacle comprises a pair of grooves on opposing sides of said body portion, and a support is received in said grooves for holding said receptacle at an angle;

wherein said support comprises a substantial U shaped member having rods on opposing ends for being received into said grooves to allow said support to pivot with respect to said receptacle, said support further comprising two substantially straight members extending from said rods and a curved portion joining said two substantially straight portions opposite said rods, said curved portion conforming to a share of said body portion;

whereby said rods slide along said grooves to change a position of said support with respect to said body portion to thereby adjust said angle of said receptacle.

12. The container of claim 11 further comprising a cover removably attachable to said receptacle, said cover defining an enclosure that is sized and dimensioned for receiving said cap and said nipple therein.

13. The container of claim 12, further comprising a safety seal removably attached to said rim and covering said opening, and a ring seal between said cover and said receptacle for indicating when said cover has been removed from said receptacle.

14. The container of claim 13, wherein said gripping surfaces comprise a rubber material disposed in a central portion of the receptacle.

15. The container of claim 11, wherein said gripping surfaces comprise a surface which is roughened as compared to a remainder of said receptacle.

16. A container for providing a liquid for an infant or small child, said container comprising:

a receptacle for receiving said liquid, said receptacle comprising a body portion and a neck portion, said neck portion having a rim defining an opening;

wherein said body portion of said receptacle comprises a pair of grooves on opposing sides of said body portion, and a support is received in said grooves for holding said receptacle at an angle;

wherein said grooves extend in a direction from a bottom of said body portion toward said neck portion; and wherein said support comprises a substantial U shaped member having rods on opposing ends for being received into said grooves to allow said support to pivot with respect to said receptacle, said support further comprising two substantially straight members extending from said rods and a curved portion joining said two substantially straight portions opposite said rods, said curved portion conforming to a shape of said body portion;

whereby said rods slide along said grooves to change a position of said support with respect to said body portion to thereby adjust said angle of said receptacle.

* * * * *